US005967530A

United States Patent [19]

Chung

[11] Patent Number: 5,967,530

[45] Date of Patent: Oct. 19, 1999

[54] ROLLER SKATE HAVING MAGNETIC APPARATUS

[76] Inventor: Fa-Chih Chung, 5F., No. 498-6, Lun-Ping S. Rd., Ping-Ho Li, Changhua City, Taiwan

[21] Appl. No.: 08/985,351

[22] Filed: Dec. 4, 1997

[51] Int. Cl.[6] ..... A63C 17/00

[52] U.S. Cl. ..... 280/11.19; 280/11.27

[58] Field of Search ..... 280/11.19, 11.22, 280/11.23, 11.24, 11.25, 11.27; 384/446; 310/90.5

[56] References Cited

U.S. PATENT DOCUMENTS 5,536,026 7/1996 Pozzobon et al. ..... 280/11.22
5,709,395 1/1998 Lee ..... 280/11.2

*Primary Examiner*—Lanna Mai
*Assistant Examiner*—David R. Dunn
*Attorney, Agent, or Firm*—Browdy and Neimark

[57] ABSTRACT

A roller skate has a magnetic apparatus, equipped with a rotary front wheel, four screw posts, and a wheel seat secured to the four screw posts via a fixing plate disposed at the top of the wheel seat. The wheel seat is equipped with a wheel shaft hole for a wheel shaft to be led there-through and a connecting tube communicating with the wheel shaft hole for a plastic screw rod be screwed up thereto. Both ends of the wheel shaft are engaged with a rolling wheel respectively and the middle periphery of the wheel shaft is milled with equidistant V-shaped magnetic grooves into which magnetic polarity is implanted at one vertical face respectively. A magnetic block of the same polarity as that of the V-shaped magnetic grooves is embedded at the interior of the plastic screw rod so that the force of repulsion is generated to trigger off the rotary movement of the wheel shaft which in turn will activate the rotation of the rolling wheels. Thus, the momentum of the roller skate is greatly increased without applying much pushing force to it in skating. In addition, the plastic screw rod is adjustable adapted to the wheel seat so as to adjust the speed of skating for different needs. For a beginner, the plastic screw rod can also be removed from the connecting tube so as to avoid danger due to unskilled practice.

2 Claims, 4 Drawing Sheets

ROLLER SKATE HAVING MAGNETIC APPARATUS

BACKGROUND OF THE INVENTION

The present invention is related to a roller skate having a magnetic apparatus, especially to a roller skate having a rotary front wheel, four screw posts, and a wheel seat secured to the four screw posts via a fixing plate disposed at the top of the wheel seat. The wheel seat is equipped with a wheel shaft hole through which a wheel shaft having equidistant V-shaped magnetic grooves disposed thereon is led. A plastic rod embedded with a magnetic block therein is screwed up to a connecting tube communicated with the wheel shaft hole thereof. Both V-shaped magnetic grooves and the magnetic block are of the like polarity so that the force of repulsion is generated to trigger off the movement of the wheel shaft which in turn can activate the rotation of rolling wheels. Thus, the momentum of the roller skate is greatly increased without much pushing force being put into it. In addition, the plastic screw rod is adjustably screwed up to the connecting tube so as to adjust the speed of the skate for different needs. For a beginner, the plastic screw rod can even be removed therefrom so as to avoid danger as a result of unskilled practice.

A conventional roller skate is characterized by the use of four rolling wheels fixedly distributed at the four corners of the sole, which provide a stable support to skate on a smooth ground. Yet, although stable in skating, such a conventional roller skate may also hinder the agility of a user in skating. Because the rolling wheels are fixed secured to the sole, it is very difficult for a skater to make a turn in skating. In addition, a user must put in great pushing force but enjoy only a limited speed in skating. Consequently, a one-line roller skate is promoted to overcome the disadvantages of said roller skate. With rolling wheels aligned and fixed in one line to reduce the resistance of the ground, said one-line roller skate is quite agile in skating. Nevertheless, it is very unstable and difficult to learn and control. In addition, the fixed one-line rolling wheels are hard to make a turn, though a little better than that of the four-wheel roller skate above.

SUMMARY OF THE PRESENT INVENTION

It is therefore the primary object of the present invention to provide a roller skate having a magnetic apparatus, especially to a roller skate equipped with a rotary front wheel for easy turning, four screw posts secured to a wheel seat, and the wheel seat having a wheel shaft provided with two rolling wheels being led there-through. The wheel shaft is milled with equidistant V-shaped magnetic grooves at the middle periphery. A plastic screw rod having a magnetic block embedded therein is screwed up to a connecting tube of the wheel seat. Both V-shaped magnetic grooves and the magnetic block are of the same polarity so that force of repulsion is generated to trigger off the movement of the wheel shaft and thus the rotation of the rolling wheels. Consequently, the momentum of the roller skate is greatly increased without much pushing force being put into it. In addition, the plastic screw rod is adjustably adapted to the connecting tube so as to adjust the speed of skating for different needs. For a beginner, the plastic screw rod can also be unmoved so as to avoid danger due to unskilled practice.

DETAILED DESCRIPTION OF THE PREFERRED EMBODIMENTS

Figure 1:
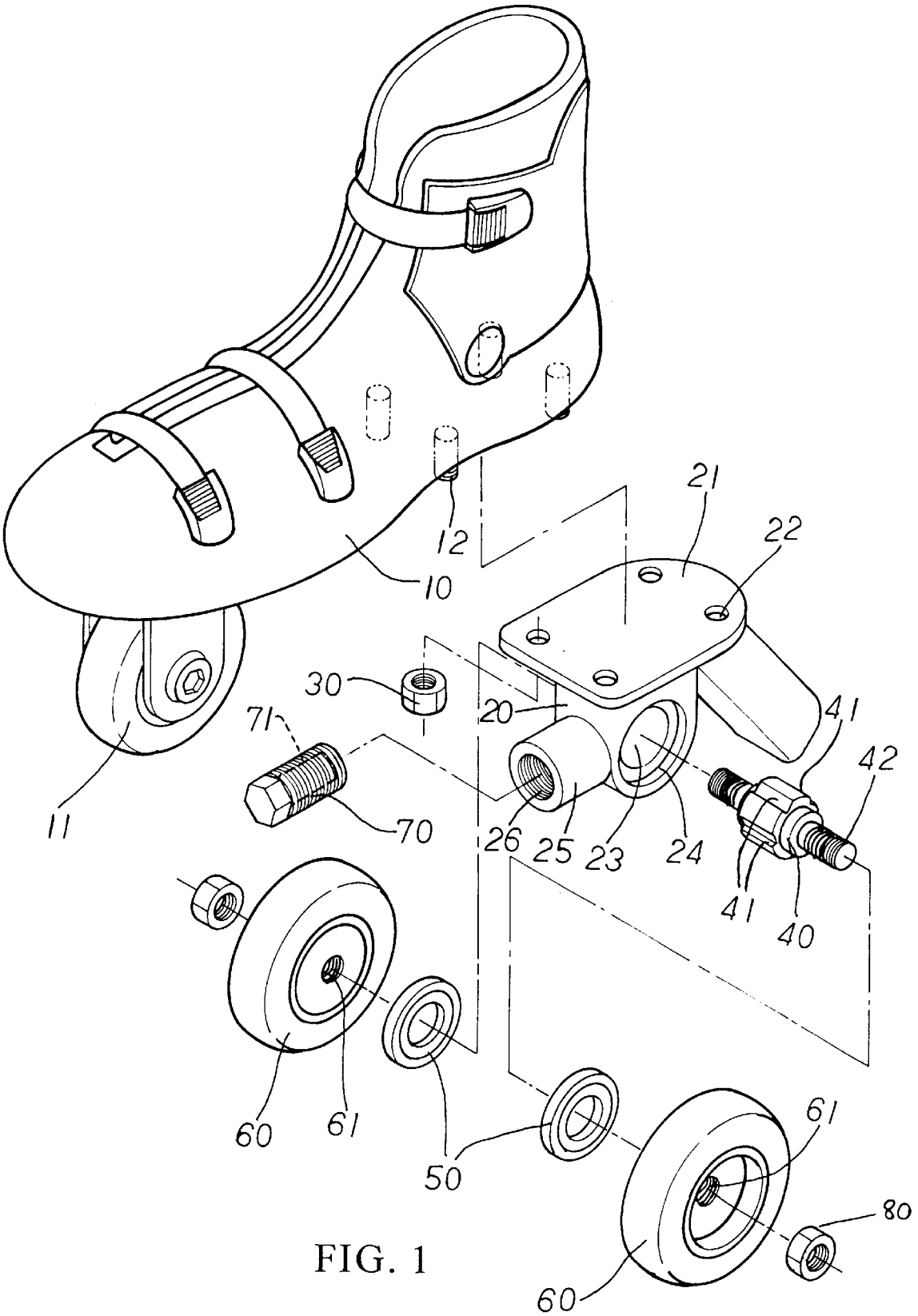
FIG. 1 is a perspective exploded view of the present invention.

Please refer to FIG. 1. The present invention is related to a roller skate having a magnetic apparatus wherein the roller skate 10 is provided with a rotary front wheel 11 disposed at the front sole, and four screw posts 12 distributed at the four corners of the rear sole thereof. A wheel seat 20 is equipped with an integrally molded top fixing plate 21 having four through holes 22 disposed thereon corresponding to the four screw posts 12 thereof so as to be secured thereto via screw nuts 30. The wheel seat 20 is provided with a wheel shaft hole 23 transversely disposed at the main body thereof wherein a bearing stage-groove 24 defines both openings of the wheel shaft hole 23 respectively. A connecting tube 25 having a tube hole 26 disposed at the interior therein is extended at the front of the wheel seat 20 and communicated with the wheel shaft hole 23 thereof. In addition, the connecting tube 25 is provided with inner threads disposed at the interior wall thereof. A wheel shaft 40 is then adapted to be led through the wheel shaft hole 23. The wheel shaft 40 is milled with V-shaped grooves 41 equidistantly distributed at the periphery of the middle section thereof. Each of the V-shaped grooves 41 is implanted at one vertical face 41' with this magnetic polarity of a magnet. Two securing members 42 having outer threads disposed thereon are extended at both ends of the wheel shaft 40 thereof.

Figure 2:
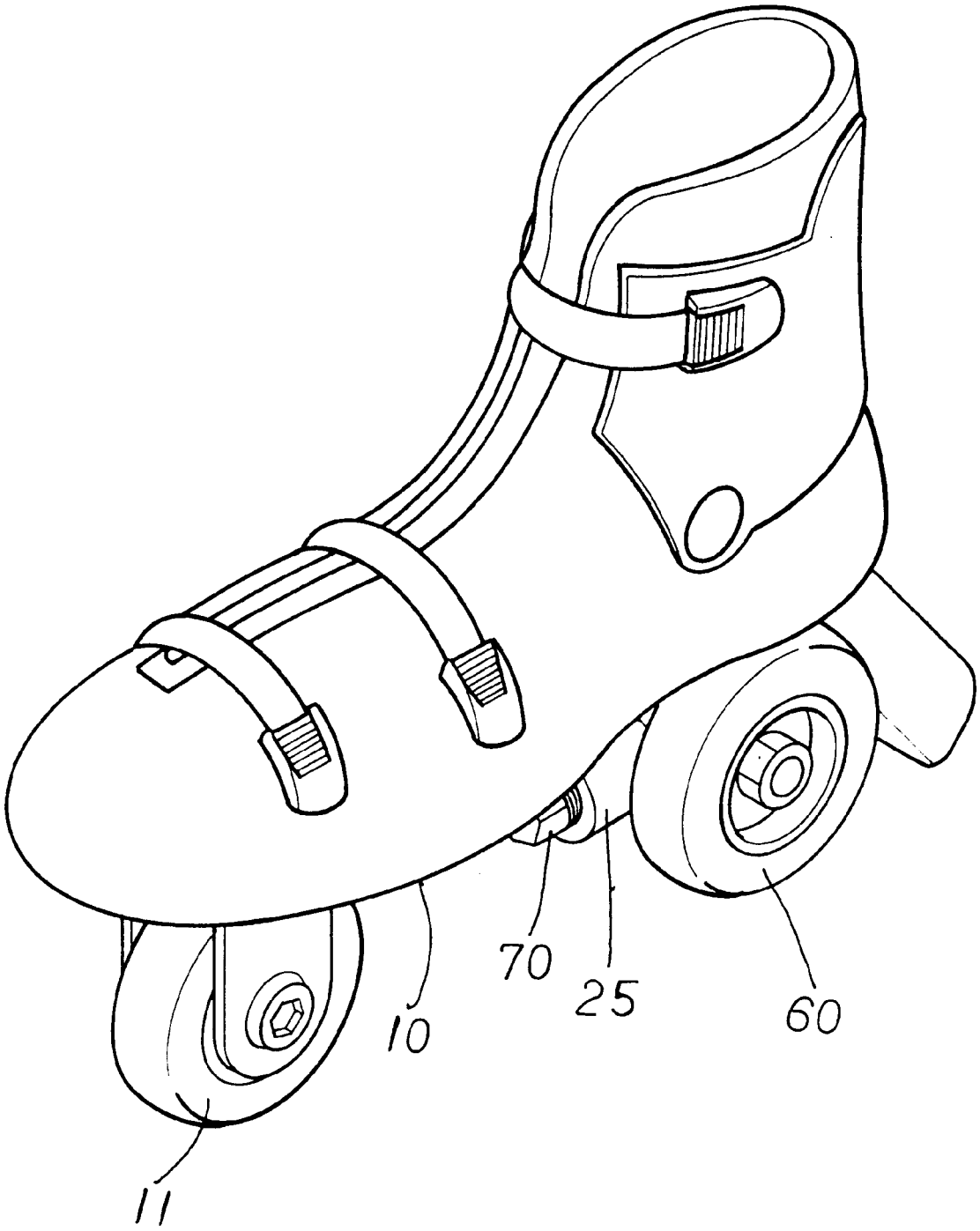
FIG. 2 is a perspective assembled view of the present invention.

Please refer to FIG. 2. In assembly, the wheel shaft 40 is led through the wheel shaft hole 23 thereof, having the milled V-shaped grooves 41 received at and both securing members 42 protruding out of the wheel shaft hole 23 thereof. A bearing 50 is then adapted to be led through one end of the securing member 42 to abut against the bearing stage-groove 24. The bearing 50 can support the rotary movement of the wheel shaft 40 within the wheel seat 20 smoothly. Via a screw hole 61 disposed at the center, a rolling wheel 60 is then tightly screwed up to the securing member 42 protruding out of the wheel shaft hole 23. A nut 80 is further adapted to be screwed up to the securing member 42 so as to doubly fix the rolling wheel 60 tightly in abutment against the wheel shaft 40. In addition, a plastic screw rod 70 having a magnet block 71 of the like polarity of the V-shaped grooves 41 embedded therein is screwed up to the inner threads of the connecting tube 25 with the end of the plastic screw rod 70 approaching the V-shaped grooves 41 of the wheel shaft 40 received at the wheel shaft hole 23 thereof to accomplish the assembly.

Figure 3:
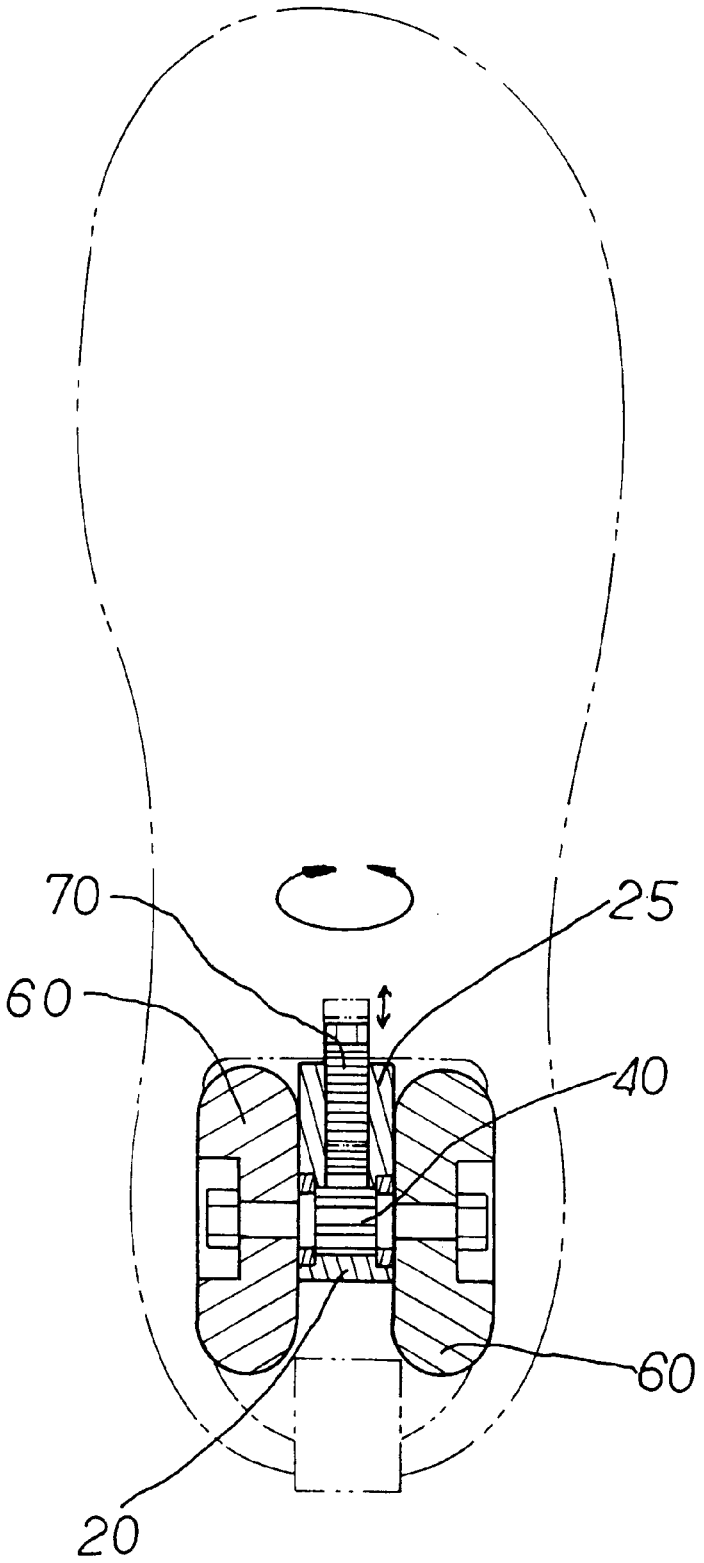
FIG. 3 is a sectional bottom view showing the assembly of the present invention.
Figure 4:
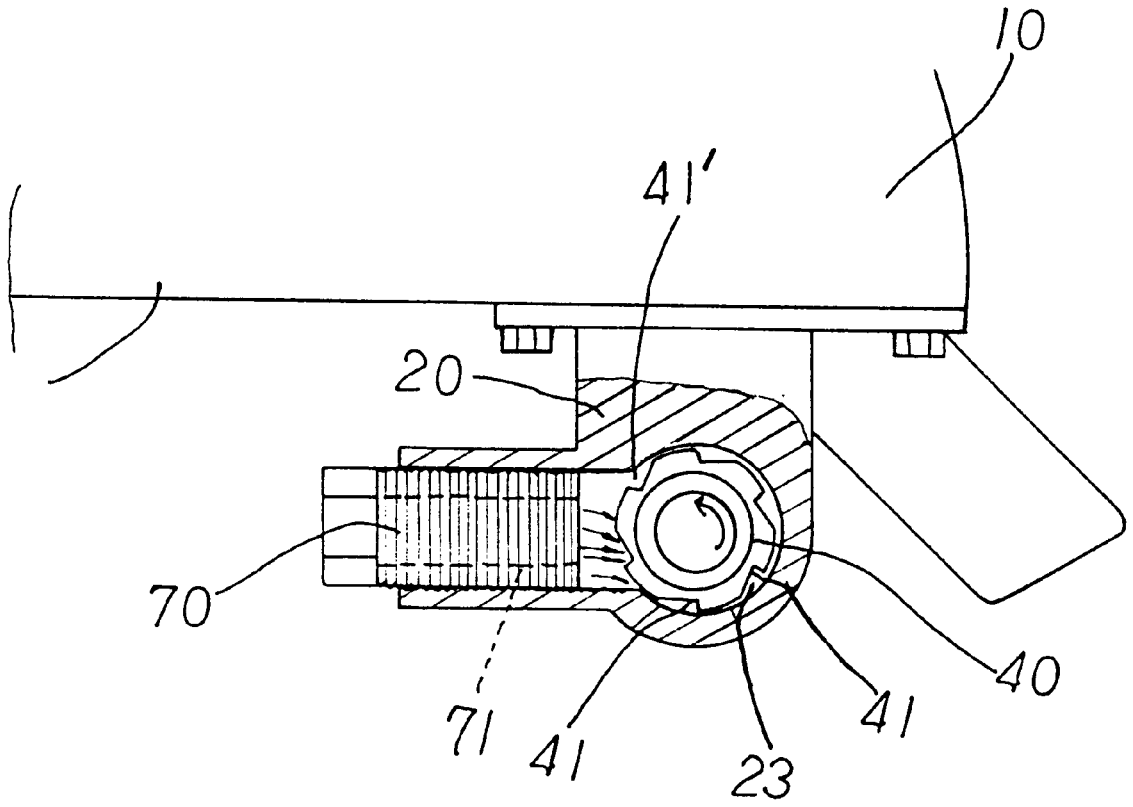
FIG. 4 is a cross sectional view showing the operation of the present invention.

Please refer to FIG. 3. When the plastic screw rod 70 is screwed up to the connecting tube 25 communicated with the wheel shaft hole 23 of the wheel seat 20, the magnetic block 71 faces the vertical face 41' of the V-shaped grooves 41 of the like polarity. Via the force of repulsion generated by the same magnetic polarity between one end of block 71 and vertical face 41', the wheel shaft 40 is activated to rotate more quickly and easily which in turn will trigger off the movement of the rolling wheel 60. Thus, the momentum of the roller skate 10 is greatly increased without applying much pushing force to it. In addition, the rotary front wheel 11 can control the direction in easy turning.

Moreover, the plastic screw rod 70 is adjustably adapted to the connecting tube 25 of the wheel seat 20 as shown in FIG. 3. The plastic screw rod 70 can be screwed up at different stages so that the distance between the magnetic block 71 and the V-shaped grooves 41 can be varied so as to adjust the speed of skating for different needs. In case of a beginner, the plastic screw rod 70 having the magnetic block 71 can also be removed therefrom so as to avoid danger due to unskilled practice.

What is claimed is:

1. A roller skate having a magnetic apparatus and a rotary front wheel to control direction; said roller skate comprising;

a rotary front wheel disposed on a front sole, and threaded screw posts distributed on a rear sole; a wheel seat having a top fixing plate with through holes for said screw posts, said wheel seat secured to said rear sole by screw nuts threaded on said screw posts; said wheel seat having a transverse wheel shaft in a main body thereof, a bearing groove on each openings of said wheel shaft hole; a connecting tube having a tube hole extending from a front of said wheel seat; said tube hole communicating with said wheel shaft hole; said connecting tube having threads disposed on an interior wall thereof; a wheel shaft having V-shaped grooves equidistantly distributed on a periphery of a middle section thereof; each of said V-shaped grooves having a vertical face with an exposed magnetic polarity; two securing members having outer threads disposed thereon extending from ends of said wheel shaft;

said wheel shaft being inserted into said wheel shaft hole with said securing members extending out of said wheel shaft hole; a bearing engaged in each said bearing groove; each said bearing supporting rotation of said wheel shaft within said wheel seat; a wheel rotatably engaged on each of said securing members; a nut fastened on each of said securing members to fix said wheel in abutment against said wheel shaft; a plastic screw rod having a magnet block screwed into said inner thread of said connecting tube with an end of said magnet block exposed toward said V-shaped grooves, wherein adjacent faces of said magnet block and said vertical face respectively have a same polarity and as said wheel shaft rotates a force of repulsion generated between said vertical face and said end of said magnetic block assists rotation of said wheel shaft and each wheel thereon.

2. The roller skate having magnetic apparatus as claimed in claim 1 wherein said plastic screw rod is adjustable in said connecting tube of said wheel seat to permit said plastic screw rod to be screwed to different positions so that a distance between said magnetic block and each said vertical face can be varied to adjust the force of repulsion.

* * * * *